US005918732A

United States Patent [19]

Heins et al.

[11] Patent Number: 5,918,732

[45] Date of Patent: Jul. 6, 1999

[54] POWER CIRCUIT BREAKER WITH A BREAKER MECHANISM AND A BREAKER MECHANISM FOR A POWER CIRCUIT BREAKER WITH A LOCK FOR A LOW-VOLTAGE SWITCH

[75] Inventors: Volker Heins, Meckenheim; Bogdan Zabrocki, Neunkirchen-Seelscheid, both of Germany

[73] Assignee: Klöckner-Moeller GmbH, Bonn, Germany

[21] Appl. No.: 08/848,081

[22] Filed: May 29, 1997

Related U.S. Application Data

[63] Continuation-in-part of application No. PCT/EP95/04461, Nov. 14, 1995.

[30] Foreign Application Priority Data

Nov. 29, 1994 [DE] Germany ..... 44 42 417

[51] Int. Cl.[6] ..... H01H 71/52

[52] U.S. Cl. ..... 200/401; 200/425

[58] Field of Search ..... 200/401, 425, 200/325, 323

[56] References Cited

U.S. PATENT DOCUMENTS

| | | | |
|---|---|---|---|
| 3,562,469 | 2/1971 | Peck . | |
| 4,935,712 | 6/1990 | Oyama et al. . | |
| 5,579,901 | 12/1996 | Faber et al. | 200/401 |

FOREIGN PATENT DOCUMENTS

| | | |
|---|---|---|
| 0584503 | 3/1994 | European Pat. Off. . |
| 2686453 | 7/1993 | France . |
| 1130036 | 5/1962 | Germany . |
| 4227213 | 2/1994 | Germany . |

*Primary Examiner*—Renee S. Luebke
*Attorney, Agent, or Firm*—Nils H. Ljungman & Associates

[57] ABSTRACT

The present invention relates to a switch latch for a power switch comprising a switching gate, two toggle levers which are connected by means of a toggle-lever axle, a helical latch spring and a release lever allowing the control of the change-over point, and thus the control of the release of the switching shaft.

20 Claims, 7 Drawing Sheets

POWER CIRCUIT BREAKER WITH A BREAKER MECHANISM AND A BREAKER MECHANISM FOR A POWER CIRCUIT BREAKER WITH A LOCK FOR A LOW-VOLTAGE SWITCH

CONTINUING APPLICATION DATA

The present invention is a continuation-in-part of International Patent Application No. PCT/EP95/04461, filed Nov. 11, 1995, having publication number WO 96/17368, published on Jun. 6, 1996, in which the United States of America was a designated state and in which the United States of America remains a designated state as of the filing of the Patent Application. International Application No. PCT/EP95/04461 was pending as of the filing date of this application.

FIELD OF THE INVENTION

The invention relates to a switch latch for a low-voltage switching device, especially for a power switch or a switch-disconnector. The switch latch comprises a casing and a switching gate, which switching gate is supported in a swivelling position in the casing and which switching gate is movable for switching-on and switching-off by means of an operating element. The operating element comprises two toggle levers, which toggle levers are connected with one another by means of an axle. The toggle levers are supported in a swivelling manner against the dynamic effect brought about by a latch spring. The swivelling end of the toggle levers, (which swivelling end comprises the toggle-lever axle), is hinched or hitched upon a switching shaft, which switching shaft is supported in a turnable position in the casing, and which switching shaft is equipped with movable contact pieces. The latch spring is arranged between the switching gate and the toggle-lever axle.

BACKGROUND INFORMATION

Switch latches according to the generic type are known, e.g., from German Patent No. 42 27 213 A1. The content of German Patent No. 42 27 213 will be incorporated into the present application. German Patent No. 42 27 213 A1 describes a switch latch which opens in a reliable way, and which switch latch presents advantages for manufacture that are brought about by a corresponding design. A system which includes a switching gate, toggle levers, and latch spring can especially form a simple but effective snap-action contact system. In low-voltage switching devices, it is often advantageous to aim at improved switching properties by increasing the contact force exerted between the contact pieces. But this is made difficult by the limited amount of force available from the switch latch.

The change-over point, at which change-over point the switch latch is switched on, and which change-over point is determined by the latch spring that exerts a force upon the support of the toggle levers at the supporting lever, has also been found to scatter even beyond the desired range under the effect of friction and manufacturing tolerances in switch latches of a design that is known, e.g., from German Patent No. 42 27 213 A1. The spring pretension of the latch spring may not be sufficient to achieve a full switching operation for the switching shaft and for the contacts when the change-over point scatters in the direction of "too early."

In other words, the latch spring exerts a force upon the support of the toggle levers. This force determines the change-over point at which change-over point the switch latch is switched on. This change-over point ideally occurs at some point in a pre-determined range. Due to friction and manufacturing tolerances in known switch latches, the change-over point has been found to scatter and move to a point outside of the desired pre-determined range. When the change-over point occurs "too early", i.e. at a point before the pre-determined range, the spring pretension of the latch spring may not be sufficient to achieve a full switching for the switch shaft and, consequently, for the contacts.

In turn, this may cause faulty contacting within the switching device itself and thus lead to erratic electrical behavior of the systems connected to it. The excessive scattering of the change-over point makes the temporal and logical coordination of the control points for auxiliary equipment more difficult since the operation of auxiliary equipment, e.g., of auxiliary switches, also depends on the position of the toggle lever of the switch latch.

When the switch latch is closed too slowly, friction may prevent the switch latch from developing the dynamic energy which is required to close the contacts completely. This also leads to errors in the electric behavior of the system.

OBJECT OF THE INVENTION

The object of the present invention is to allow a greater force of contact without needing a stronger latch spring for this purpose.

SUMMARY OF THE INVENTION

This object can be achieved in a switch latch according to the generic type in such a way that the switch latch provides a release lever, which release lever is turnable around a stationary axle or axis, and which release lever is subjected to the action of a force exerted by a pretensioning spring. The release lever can intervene in the path of movement followed by the switching shaft by means of a latching stop. The unblocking of the path of movement of the switching shaft is achieved by activating the release lever with the help of the operating element in such a way that the movement made by the switching shaft in order to close the contacts will only be unblocked by the operating element after exceeding the theoretical change-over point of the switch latch during the process of switching-on.

In this way, a pretensioned release lever is provided according to the present invention, and the release lever achieves blocking by means of a latching surface, i.e, by means of a latching stop of the switching shaft which comprises the contact device. This release lever is activated, i.e., released according to the position of the operating element in such a way that the release is only brought about after exceeding the theoretical change-over point of the latch switch.

In accordance with the present invention, this means that it can be possible to exceed the theoretical change-over point, and to use a so-called "controlled change-over point" in order to trigger the switching-on or engaging of the switching shaft, i.e., the movement made by the switching shaft to switch on the contacts only after this.

In accordance with the invention, this means that the switching shaft remains latched even beyond the theoretical change-over point, and that the release is only brought about by the movement of the operating element, i.e., during the further movement of the operating element and with the help of a stop web which further movement is coupled to the movement of the operating element, which stop web unlatches the release lever and enables the switching-on of the contacts via the switching shaft at the desired time and at the desired position of the switch latch.

In other words, the theoretical change-over point is reached, but the latching stop of the release lever of the present invention blocks the movement of the switching shaft so that the contacts are not switched on. The latching stop only unblocks the path of movement of the switching shaft at a point beyond the theoretical change-over point. This unblocking of the release lever occurs by the movement of the operating element, which operating element comprises a stop web. The movement of the stop web unlatches the release lever at a point beyond the theoretical change-over point, thus enabling the switching-on of the contacts via the switching shaft. In this way, the "controlled change-over point" occurs after the theoretical change-over point.

An operating element according to the invention may consist, e.g., of the toggle lever of the switching device if this lever is designed as a toggle switch, or it may consist of the operating handle of a rotary drive.

The invention can prevent problems which switching shaft and contacts may present in achieving full switching operations, and which may be caused by starting too early, i.e., by the premature release of the change-over point of the latch spring.

The fact that the release of the change-over point of the latch spring is shifted to a point located after the theoretical change-over point improves leverage with regard to the forces exerted by the latch spring, and this also increases the contact-closing forces when the switching shaft is released in order to be able to carry out the switch-on movement.

In addition to this, the invention makes it possible to stabilize the change-over point for the switching-on of the switching shaft by coordinating the distances travelled by the switching gate with the release lever, i.e., by limiting them to a small tolerance in such a way that functions which depend on this, such as auxiliary switches and undervoltage releases, can be designed in a more reliable way.

The present invention makes it possible to shift switching-on by displacing the change-over point backwards beyond the theoretical change-over point. This means that the safe switching-on of the contacts is done at a later time. This makes it more certain that especially those advancing auxiliary switches, which have to be switched before the change-over point is reached, will be switched on since more time is available to switch on the auxiliary switches as well.

In this way, the present invention saves time by displacing the change-over point backwards, and this exerts a positive influence on the safe switching of both auxiliary switches and undervoltage releases.

The undervoltage release, which can be coupled to an advancing auxiliary switch for certain applications, does not carry voltage in the OFF position. The auxiliary switch is switched on first during reclosing, the undervoltage release receives voltage, and then, the mechanical block is opened in such a way that the undervoltage release can switch.

When voltage is applied to the undervoltage release, sufficient time must be available to create a magnetic field until the contacts are closed by means of the switching shaft of the switch latch to unblock the switch since the undervoltage release uses an armature and a magnetic field. The backward displacement of the change-over point of the switch latch saves enough time in a safe way so that an undervoltage release can create a magnetic field and unblock safely.

One advantageous embodiment of the present invention resides broadly in the switch latch characterized in that the release lever is arranged in such a way as to be turnable around the stationary axle around which a supporting lever, that can be carried away by the switching gate and that cooperates with a snap-in device by means of its free end, is supported in a swivelling way.

Yet another advantageous embodiment of the present invention resides broadly in the switch latch characterized in that a stop dog is formed in such a way as to project in a radial direction at at least one cam formed at the switching shaft, and which stop dog cooperates with the latching stop of the release lever.

Still another feature of the invention resides broadly in the switch latch characterized in that the toggle lever of the switching gate is connected in a fixed way with a toggle-lever support. The toggle-lever support presents a projecting stop web that is located at its lower side and which stop web hits the release lever and carries the release lever away when the desired unblocking position of the path of movement of the switching shaft is reached to close the contacts, thus releasing the snap-in connection between the release lever and the switching shaft.

It is especially provided that the release lever can be arranged in the switch latch in such a way that the release lever can turn around the stationary axle around which stationary axle the supporting lever is supported in a swivelling way. This switching gate, supporting lever and release lever have an approximately U-shaped design and can be arranged within one another and moved against one another in a simple way for this reason. The toggle lever can also have a form which form is essentially U-shaped and which U-shaped form can be obtained by the axle which links the two levers with one another, and which axle can be inserted into and moved within the space surrounded by the switching gate.

The latching surface can be located between release lever and switching shaft and can thus prevent the premature movement of the switching shaft and the premature closing of the contacts during switching-on. The latching surface is preferably formed by means of at least one stop dog or notch or protrusion that projects in a radial direction at a cam formed at the switching shaft, and that stop dog cooperates with at least one latching stop of the release lever.

In other words, the stop dog of the switching shaft couples with at least one latching stop of the release lever to block the path of movement of the switching shaft and thus prevent the switching on of the contacts.

In order to allow the release of the change-over point during the movement of the switching gate, the invention especially provides that the toggle lever, which toggle lever serves as an operating element for a toggle-lever support, and which toggle-lever support can be connected in a fixed way to the switching gate, that a stop web is formed, which stop web hits the release lever and carries it away when the desired release position is reached for the movement of the switching shaft to close the contacts, thus opening the latching between release lever and switching gate, and allowing the switching shaft to close the contacts in a safe way.

In other words, the switching gate can provide the movement which movement allows the release of the change-over point. The switching gate can be connected to a toggle-lever support. A toggle lever of the switching gate can serve as an operating element for the toggle-lever support. The toggle-lever support includes a stop web. The stop web of the toggle-lever support hits the release lever and moves the release lever when the desired unblocking position of the path of movement of the switching shaft is reached. The movement of the release lever releases the snap-in connection between the latching stop of the release lever and the stop dog of the switching shaft, thus allowing the contacts to close.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention will now be described in detail with reference to an embodiment shown in the drawing, in which:

FIGS. 6A–D are schematic views showing the function of the switch latch in the different switching positions, including OFF, the theoretical changeover point, the real changeover point, and ON.

DESCRIPTION OF THE PREFERRED EMBODIMENT

Figure 1:
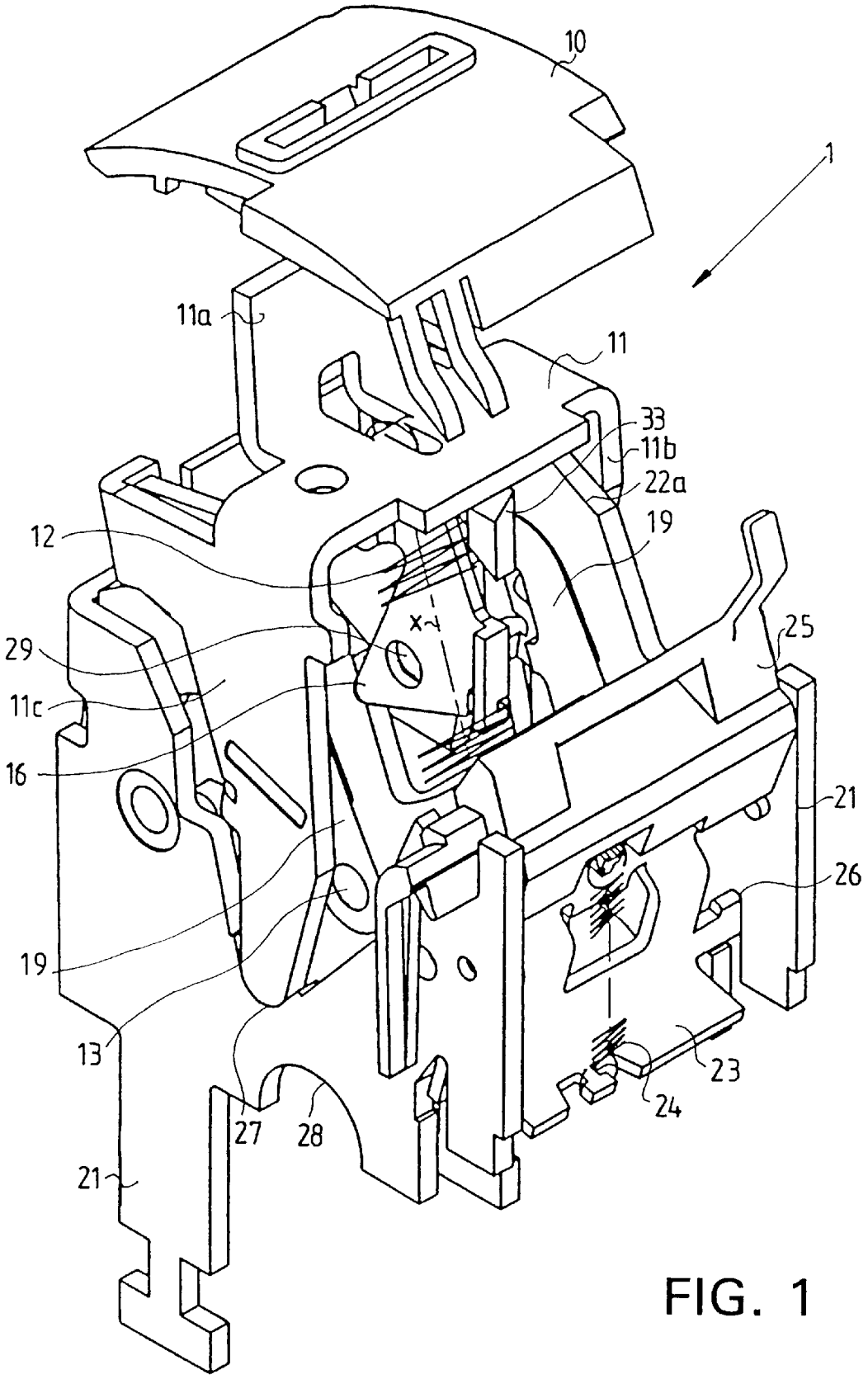
FIG. 1 is a perspective view of the switch latch with the toggle-lever support being lifted off.
Figure 2:
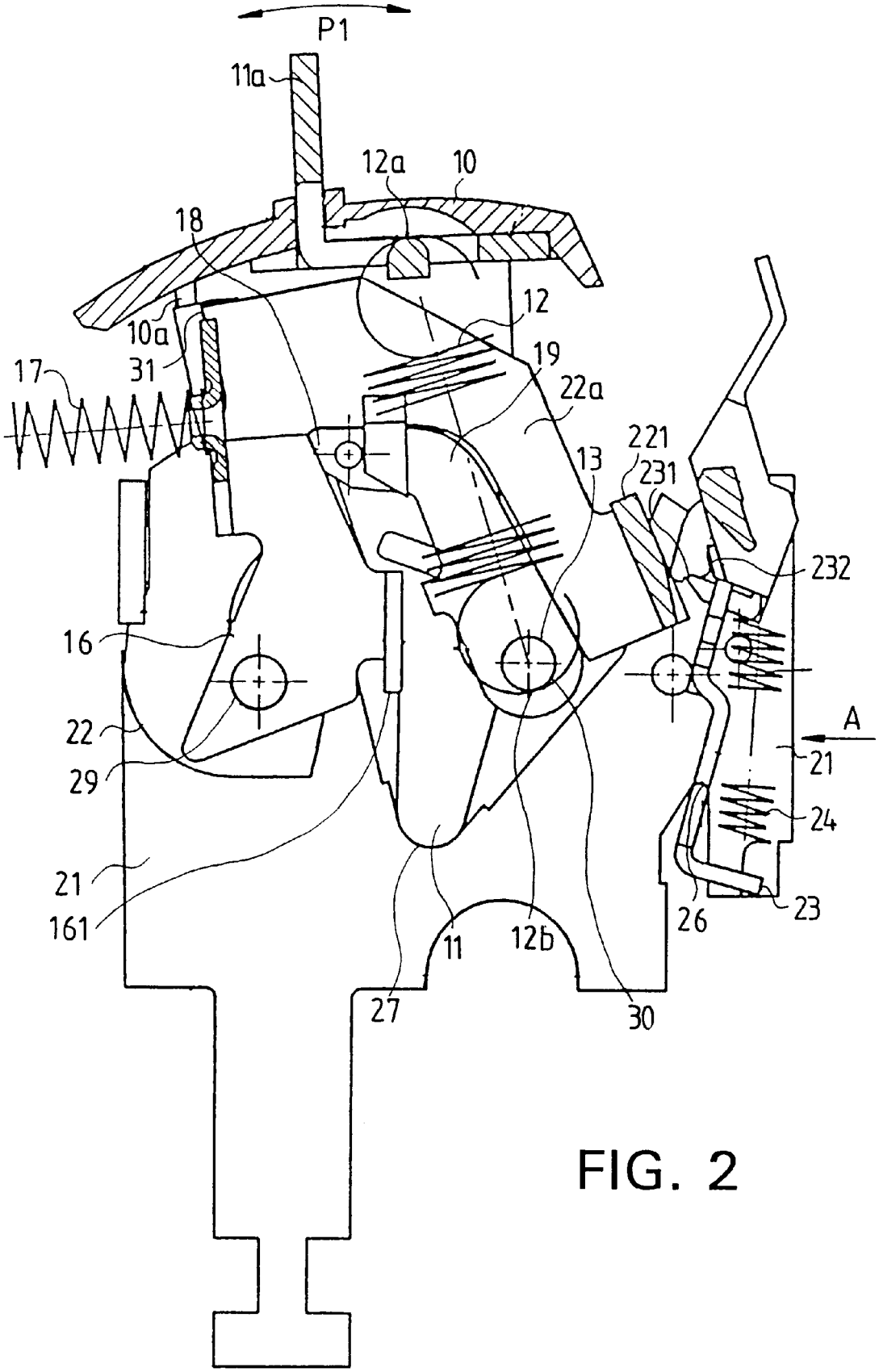
FIG. 2 is a schematic side view of the switch latch according to FIG. 1 in the ON condition.
Figure 3:
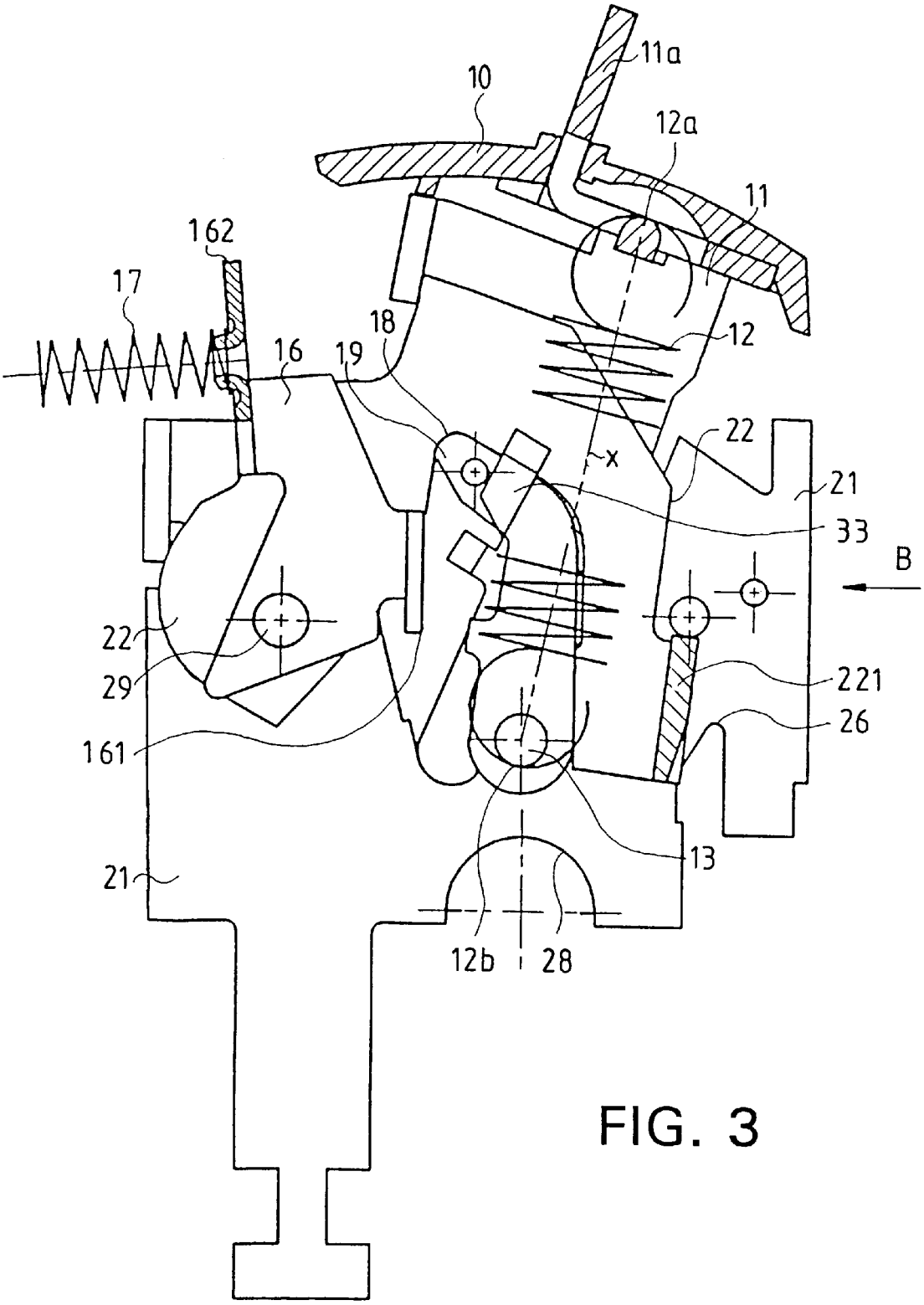
FIG. 3 is a schematic side view of the switch latch according to FIG. 1 in the OFF condition, and without the latch-lever device.
Figure 4:
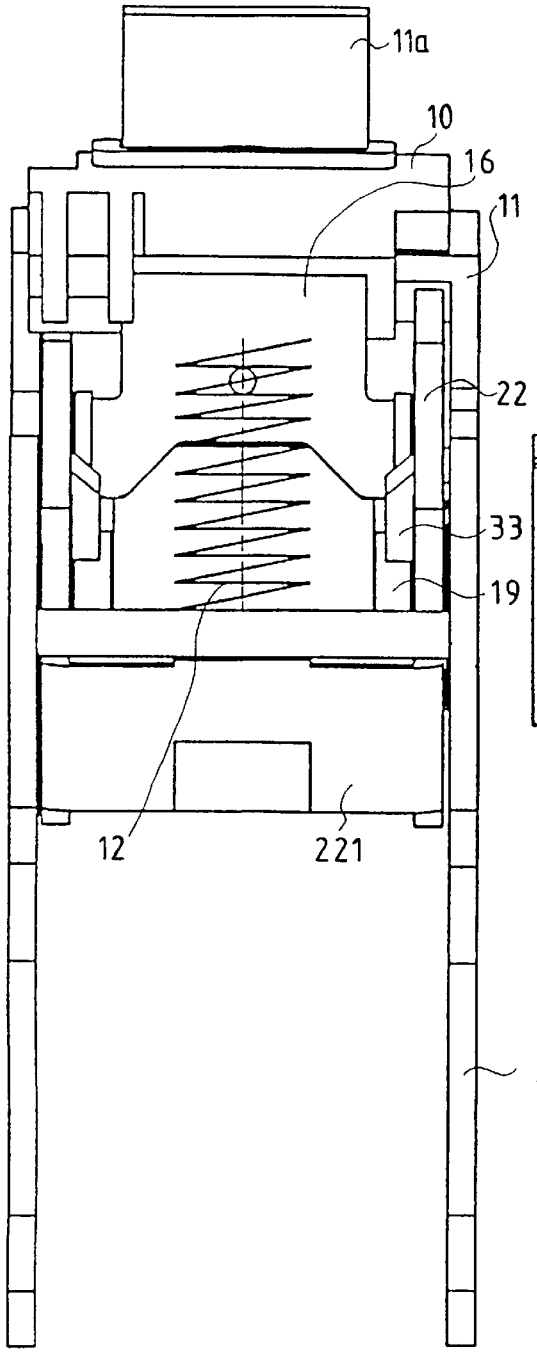
FIG. 4 is a side view B of FIG. 3 shown from the right-hand side.
Figure 5:
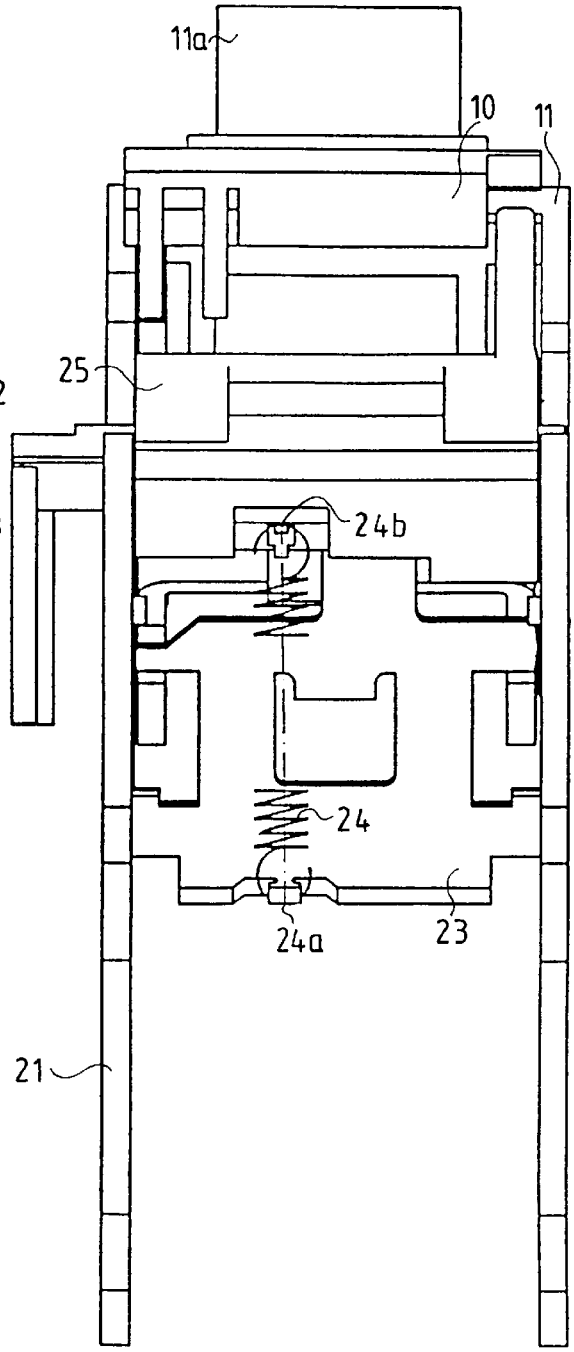
FIG. 5 is a side view A of FIG. 2 shown from the right-hand side.

FIG. 1 shows the switch latch 1 as it is inserted as a part of a power switch into a moulded casing that is not shown in the drawing. The switch latch 1 is shown without the switching shaft 20 that carries the movable contacts 70 (see FIGS. 6A–D). The switch latch 1 consists of the two lateral latch plates 21, by means of which latch plates 21 the switch latch 1 is fixed in the moulded casing. In addition to this, the switch latch 1 comprises the switching gate 11, which switching gate 11 has a U-shaped design, and which switching gate 11 swivels on a bearing 27 of the latch plate 21 by means of the two legs of the U-shaped form. The switch latch 1 further comprises two toggle levers 19, which toggle levers 19 are connected with one another in a fixed way by means of a toggle-lever axle 13, a helical latch spring 12 and a latching device, which latching device includes a latching lever 23, a latching spring 24 and a latch 25. The switch latch 1 further comprises a release lever 16 with pretensioning spring 17 (see FIGS. 2 and 3, for the release of the switching shaft that is not shown in the drawing).

FIGS. 1 through 5 show that the switching gate 11 has an essentially U-shaped design and includes the two lateral legs 11*c* and 11*b*, which legs 11*c* and 11*b* are supported in the recess 27 of the latch plates 21, swivelling in the direction of arrow P1. A toggle lever 11*a* is formed in a projecting way at the web of the switching gate 11 which switching gate 11 links the two legs 11*c*, 11*b*.

A U-shaped supporting lever 22 is arranged within switching gate 11, and the supporting lever 22 is supported in a swivelling way against the force exerted by latch spring 12 on two bearing rivets. The bearing rivets are mounted at the inside on the latch plates 21, and the bearing rivets form a stationary axle 29 for the swivelling of the supporting lever 22. The supporting lever 22 is moved from the released into the OFF position by means of the switching gate 11. The two equal toggle levers 19 are connected in a fixed way to and kept at a distance by the toggle-lever axle 13. One end of the latch spring 12 applies to the center of the toggle-lever axle 13 (see bearing 12*b*) and its other end applies to the upper section of the switching gate 11 (see bearing 12*a*.) The toggle levers 19 are supported against the action of the force exerted by the latch spring 12 in the area of a bearing 18 formed by a recess in the supporting lever 22. In this way, the switching gate 11, supporting lever 22, toggle levers 19 and latch spring 12 form a simple and effective snap-action contact system.

In the overstretched condition of the snap-action contact system, i.e., when the latch spring 12 has reached its greatest extension in an intermediate position between the OFF and the ON condition of the switch latch 1, i.e., at the theoretical change-over point, the contact points of the toggle levers 19 of the bearings 18 of the supporting lever 22 are in the same plane as the points of application of the latch spring 12 at the switching gate 11 or, respectively, at the toggle-lever axle 13. The toggle levers 19 are kept at a distance by the toggle-lever axle 13, and the toggle levers 19 are guided laterally by means of one guiding cam 33 each, formed at the lateral legs of the supporting lever 22.

The latch 25 swivels laterally on the latch plates 21. The latching lever 23 also swivels by means of lateral projections resting in recesses 26 located in the latch plates 21. The helical latching spring 24 is suspended and subjected to a small tensile stress between the latch 25 and the latching lever 23.

The supporting lever 22 presents an arm 22*a* which protrudes in a central position from the U-shaped section, and at which arm 22*a* a locking surface 221 is formed that cooperates with the latching device in the OFF and in the ON condition of the switch latch 1. An example of the latching device has been described in DE 42 27 213 A1. The switching shaft 20, (see FIG. 6), which is not shown in detail, and which carries contact arms 71 with the movable contact pieces 70, is supported in a turnable way at the casing of the power switch, and guided by bearings 28 of the latch plates 21. The release lever 16 has a design as shown in FIGS. 7A through C, and the release lever 16 is also supported in a turnable way at the bearing rivets, which bearing rivets form the stationary axle 29, and which bearing rivets are located at the inside of the latch plates 21. In addition to this, the release lever 16 is subjected to a slight pretension exerted by the pretensioning spring 17 which pretensioning spring 17 has its second point of application, e.g., at the casing. The release lever 16 presents the latching stops 161 located on the side that is turned away from the pretensioning spring 17, i.e., on the side that is turned toward the switching shaft 20.

The operating element of the switching gate 11, i.e., the toggle lever 11*a* is connected in a fixed way to a toggle-lever support 10. The toggle-lever support 10 presents a stop web

10*a* which stop web 10*a* is located at its lower side, and by which stop web 10*a* the toggle lever support 10 enters into cooperation with the release lever 16, i.e., with a stop projection 162 at a determined position of the movement P1 of the switching gate 11.

The axis X of the latch spring 12 is determined by its bearings 12*a*, 12*b* located on the switching gate 11, or, respectively, on the toggle-lever axle 13, and the axis X changes its position according to the position of the toggle lever 11*a*, i.e., according to the position of the switching gate 11. The toggle-lever axle 13 is guided in a bearing 30 which bearing 30 is formed at the switching shaft 20 that is not shown in the drawing (see FIG. 2). This bearing 30 actually consists of a bearing track, i.e., the toggle-lever axle 13 is supported in a movable position, and the toggle-lever axle 13 moves according to the movement of the switching gate 11 in the curve path, as can be seen from a comparison between FIGS. 2 and 3.

FIGS. 7A through 7C show the release lever 16 as it is inserted in the latch shown in FIGS. 1 through 5. The release lever 16 also has an essentially U-shaped design including lateral legs 164 which act via a connecting web 162 for establishing the cooperation with the stop web 10*a* of the operating element, i.e., of the toggle-lever support 10, at the same time.

Boreholes 160 are formed in the lateral legs 164 of the release lever 16 in order to allow for placing on the bearing rivet 29, i.e., on the stationary axle 29. Latching surfaces 161 are designed at the longitudinal sides of the legs 164 which legs 164 point in the direction of the switching shaft 20 during insertion into the switch latch 1 or, respectively, in the direction of the latching device, and the legs 164 hit corresponding blocking surfaces or, respectively, stop dogs 151, (see FIG. 6A), which stop dogs 151 are designed on the switching shaft 20, and which stop dogs 151 bring about a blocking of the movement of the switching shaft 20.

FIGS. 6A through 6D are schematic views of the functional workings of the switch latch including release lever 16 and contact system, while the parts concerning the latching device and the supporting levers 22 have been omitted in this representation.

Figure 6A:
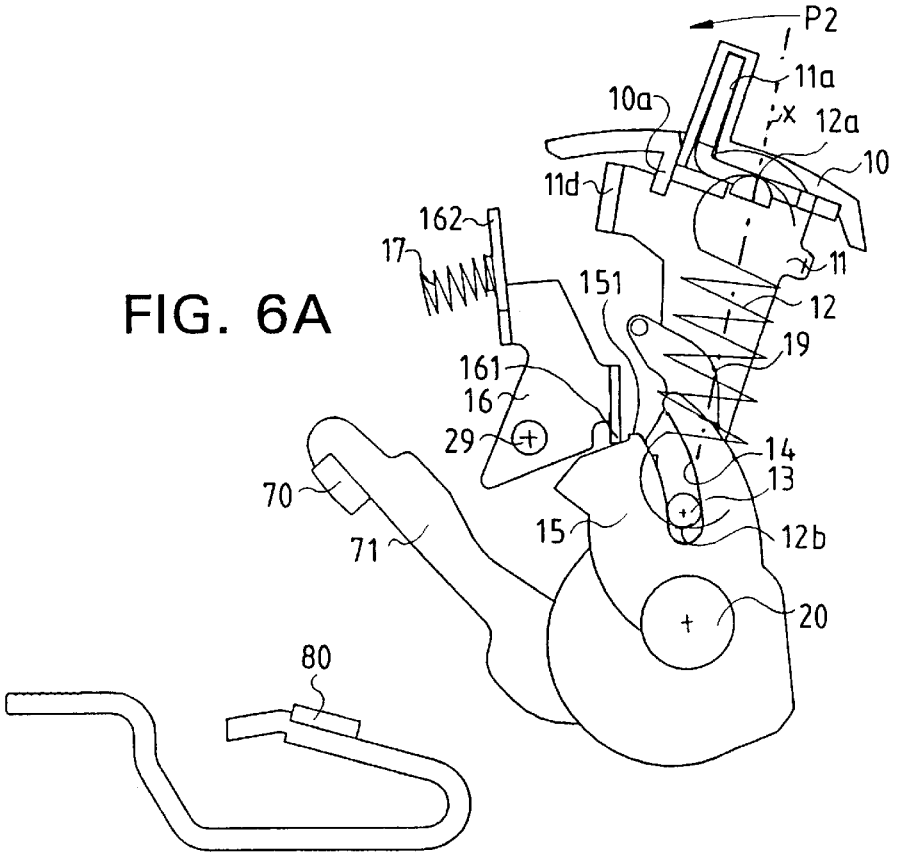
Figure 6B:
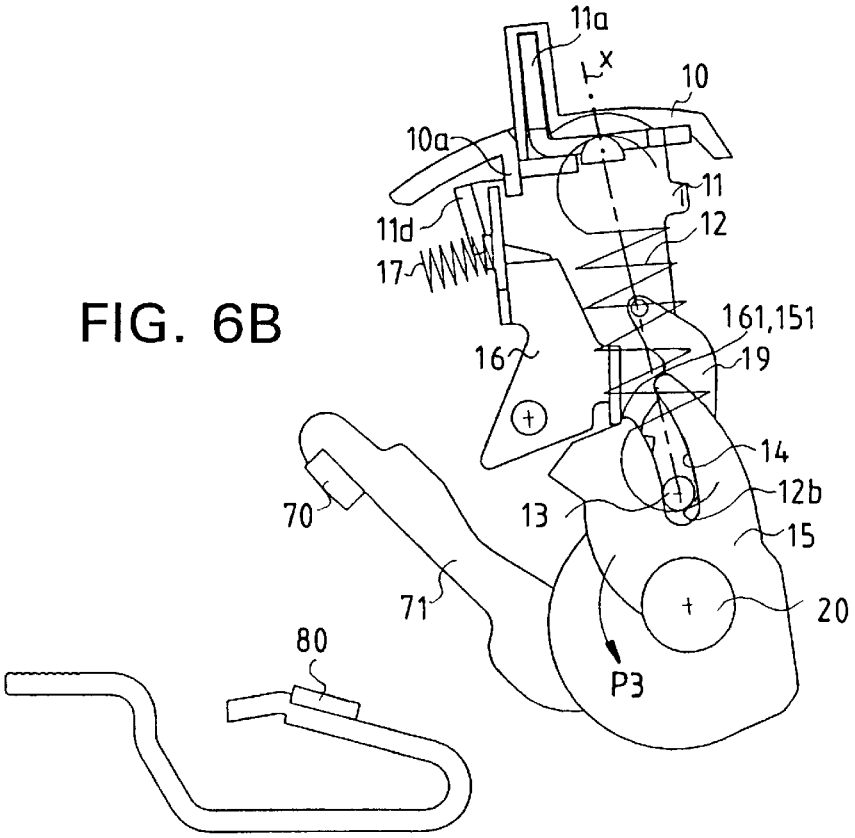
Figure 7A:
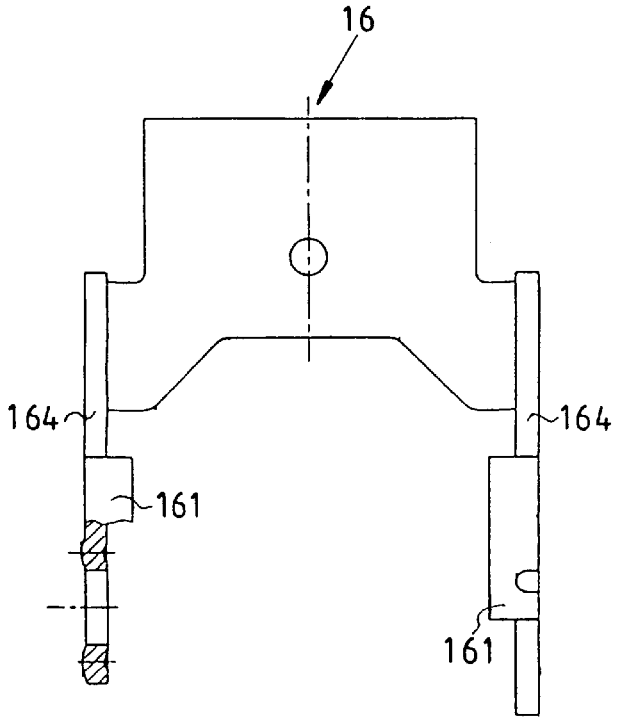
FIGS. 7A–C are representations of the release lever in three views.
Figure 7B:
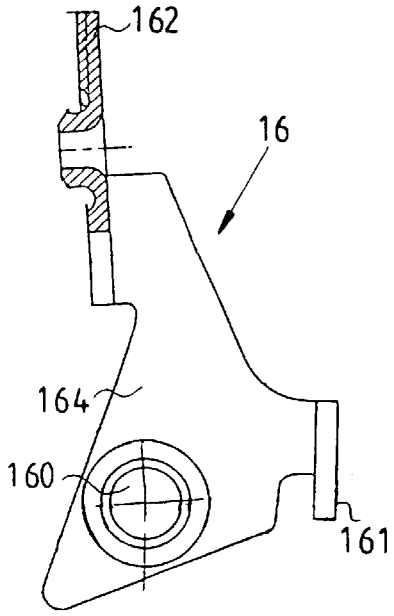
Figure 7C:
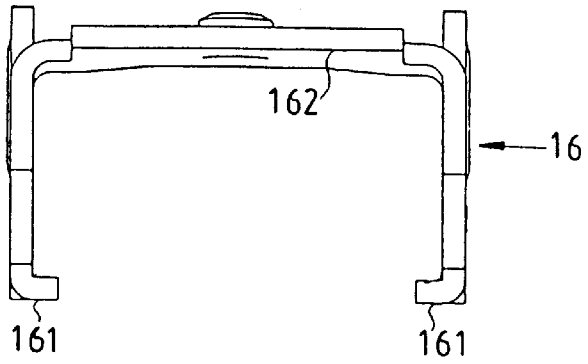

FIG. 6A shows the OFF position of the switch latch 1. This view covers the contact apparatus including the switching shaft 20, the contact arms 71 which carry the movable contact pieces 70 as well fixed stationary contact pieces 80. Two protruding cams 15 are designed on the switching shaft 20, and the cams 15 are designed with one cam slot 14 each, forming the curve path for the toggle-lever axle 13 guided in it. The protruding stop dog 151 is formed at one point on one side along the perimeter of the cams 15, and the stop dog 151 enters into cooperation with the latching stops 161 of the release lever 16. In the OFF position shown according to FIG. 6A, the release lever 16 is subjected to the pretension exerted by the pretensioning spring 17 but the release lever 16 is not in a cooperating contact with the switching shaft 20. The operating element, i.e., the toggle lever 11*a*, is now moved in order to switch on the contacts 70,80 in the direction of arrow P2. FIG. 6B shows the position when the theoretical change-over point of the latch spring 12 has been reached. In this position, the release lever 16 enters into cooperation with the switching shaft 20 in such a way that the latching stop 161 hits the stop dog 151 of the switching shaft 20 and thus blocks a movement of the switching shaft 20 in the direction of arrow P3.

Figure 6C:
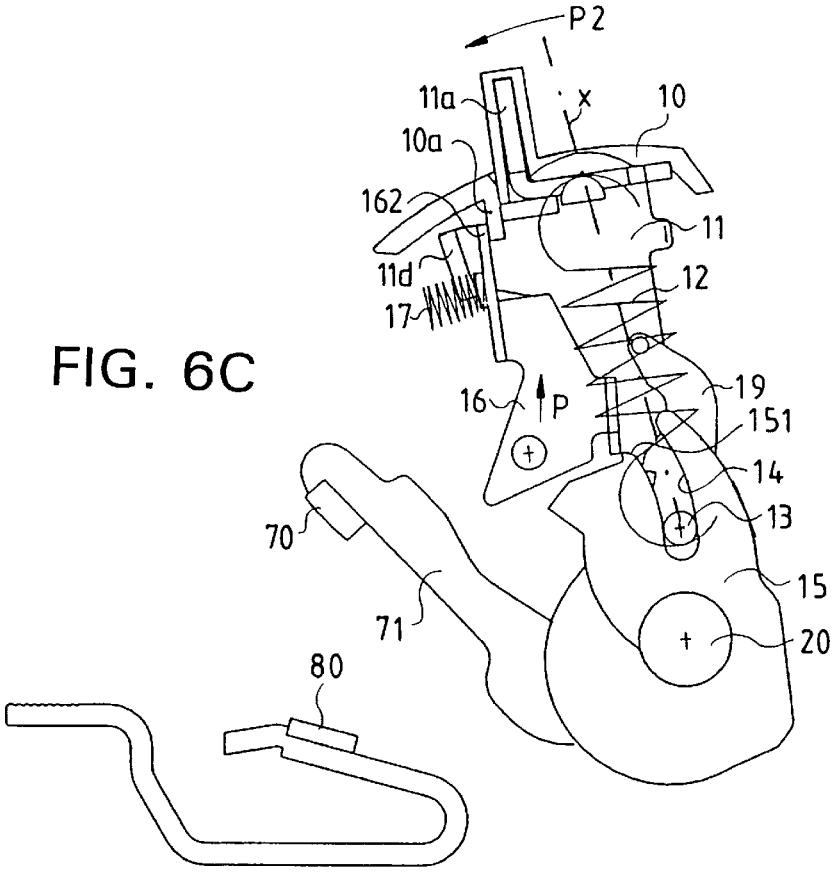
Figure 6D:
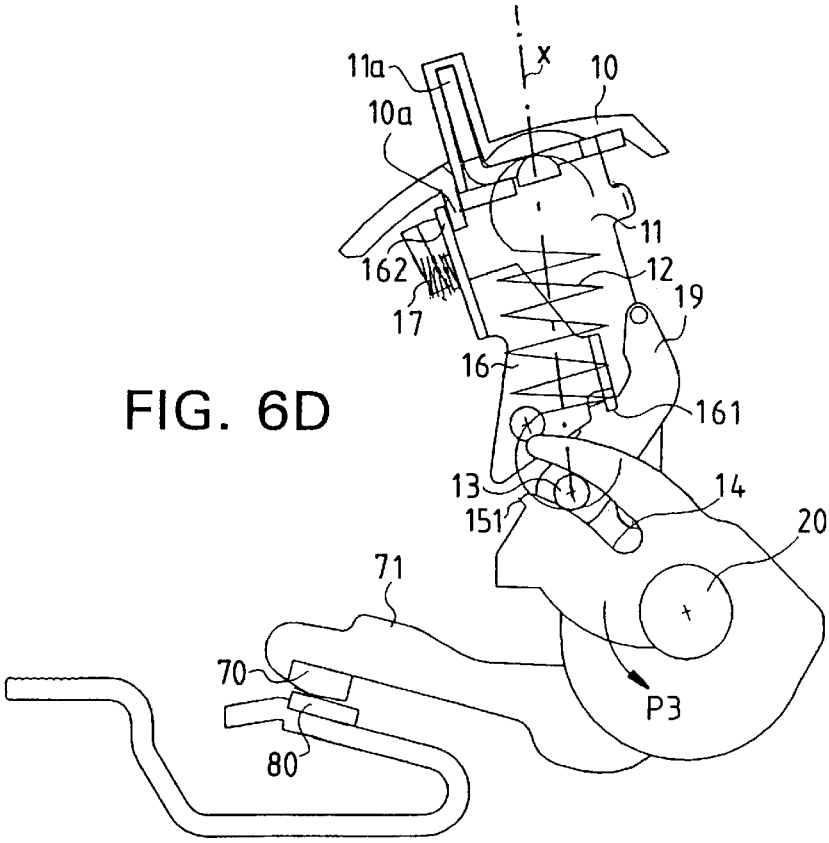

Now, FIG. 6C shows that the theoretical change-over point according to FIG. 6B is passed during the further movement of the switching gate 11 by means of the operating element 11*a*, 10 in the direction of arrow P2, and that the release lever 16 leaves the snap-in connection with the stop dog 151 of the switching shaft 20 and moves away in the direction of arrow P after a distance predetermined according to the dimensioning of the release lever 16 and of the stop dog 151. The operating element can, in one embodiment, comprise the toggle lever 11*a* and the toggle-lever support 10. The movement of the release lever 16 in the direction of arrow P is brought about by the fact that the stop web 10*a* at the lower side of the toggle-lever support 10 of the operating element hits the stop web 162 of the release lever 16 and carries the release lever 16 away, thus bringing about the release of the stop dog 151 at the other end of the release lever 16 in the area of the web 161. After the release of the switching shaft 20, i.e., after the cooperation or contact between the release lever 16 and the stop dog 151 has ended, the switching shaft 20 can move under the action of the latch spring 12 instantaneously in the direction of arrow P3 (see FIGS. 6B and 6D), and close the contacts 70, 80, applying increased contact pressure.

A comparison between FIGS. 6B and 6C shows that there is a difference between the theoretical change-over point and the controlled change-over point (concerning their position with regard to the axis X of the latch spring 12), and that the difference in the distance to be travelled between these two positions of the change-over point comprises the backward displacement of the change-over point, thus increasing the safety of latch switching. At the same time, the backward displacement of the change-over point and the locking by means of the release lever 16 at the time of the theoretical change-over point make certain that forces of a sufficiently high magnitude will always be acting upon the contacts in order to close them in a safe way, thus achieving a safe switch-on position in accordance with FIG. 6D.

One feature of the invention resides broadly in the switch latch for a low-voltage switching device, especially for a power switch or a switch-disconnector, comprising a casing with a switching gate 11 which switching gate 11 is supported in a swivelling position in the casing, and which switching gate 11 is movable for switching-on and switching-off by means of an operating element. The operating element comprises two toggle levers 19 which toggle levers 19 are connected with one another by means of an axle 13 and which toggle levers 19 are supported in a swivelling way against the dynamic effect brought about by a latch spring 12. The swivelling end of the toggle levers 19, which swivelling end comprises the toggle-lever axle 13, is hinched or hitched upon a switching shaft 20 which switching shaft 20 is supported in a turnable position in the casing, and which switching shaft 20 is equipped with movable contact pieces 70. The latch spring 12 is arranged between the switching gate 11 and the toggle-lever axle 13, characterized in that a release lever 16, being turnable around a stationary axle 29 and subjected to the action of the force exerted by a pretensioning spring 17, is provided and intervenes in the path of movement of the switching shaft 20 by means of at least one latching stop 161. The unblocking of the path of movement of the switching shaft 20 is achieved by activating the release lever 16 by means of the operating element 11*a* in such a way that the movement made by the switching shaft 20 in order to close the contacts 70, 80 is only unblocked by means of the operating element 11*a* after having exceeded the theoretical change-over point of the latch spring 12 during the process of switching-on.

Another feature of the invention resides broadly in the switch latch characterized in that the release lever 16 is arranged in such a way as to be turnable around the stationary axle 29 around which a supporting lever 22, that can be carried away by the switching gate 11 and that cooperates with a device 23, 24 by means of its free end 221, is supported in a swivelling way.

In other words, in this feature of the invention, the release lever 16 is turnable around a stationary axle. A supporting lever 22 is supported in a swivelling way around the release lever 16. The supporting lever 22 can be moved by the switching gate 11. The free end 221 of the supporting lever 22 cooperates with a device 23, 24.

Yet another feature of the invention resides broadly in the switch latch characterized in that a stop dog 151 is formed in such a way as to project in a radial direction at least at one cam 15 formed at the switching shaft 20, and which stop dog 151 cooperates with the latching stop 161 of the release lever 16.

Still another feature of the invention resides broadly in the switch latch characterized in that the toggle lever 11*a* of the switching gate 11 is connected in a fixed way with a toggle-lever support 10. The toggle-lever support 10 presents a projecting stop web 10*a* that is located at its lower side and which stop web 10*a* hits the release lever 16 and carries the release lever 16 away when the desired unblocking position of the path of movement of the switching shaft 20 is reached to close the contacts 70, 80, thus releasing the snap-in connection between the release lever 16 and the switching shaft 20.

Examples of switch latches and latching mechanisms which may be utilized in accordance with the present invention may be disclosed in the following U.S. Pat. Nos. 5,444,423 to Venzke et al. on Aug. 22, 1995, entitled "Latch Mechanism for a Circuit Breaker"; U.S. Pat. No. 5,428,329 to Grunert on Jun. 27, 1995, entitled "Springclip Means for a Latchable Operating Mechanism on a Circuit Breaker"; U.S. Pat. No. 5,392,016 to Arnold et al. on Feb. 21, 1995, entitled "Molded Case Circuit Breaker Mechanical Rating Plug"; U.S. Pat. No. 5,182,532 to Klein on Jan. 26, 1993, entitled "Thermal-magnetic Trip Unit"; U.S. Pat. No. 5,220,303 to Pannenborg et al. on Jun. 15, 1993, entitled "Molded Case Circuit Breaker Low Friction Latch Assembly"; U.S. Pat. No. 5,280,258 to Opperthauser on Jan. 18, 1994, entitled "Spring-powered Operator for a Power Circuit Breaker"; U.S. Pat. No. 5,290,982 to Beck et al. on Mar. 1, 1994, entitled "Circuit Breaker With Positive On/Off Interlock"; and U.S. Pat. No. 5,294,901 to Tacinelli et al. on Mar. 15, 1994, entitled "Molded Case Circuit Breaker Insulated Armature Latch Arrangement".

Examples of circuit breakers, and components found therein, which may be utilized in accordance with the embodiments of the present invention, may be found in the following U.S. Pat. No. 4,750,375 to Godesa, entitled "Drive Device for a Circuit Breaker with a Ratchet Wheel"; U.S. Pat. No. 4,678,873 to Preuss and Berndt, entitled "Low Voltage Circuit Breaker . . . "; U.S. Pat. No. 4,380,785 to Demayer and Claudin, entitled "Solid State Trip Unit . . . "; U.S. Pat. No. 4,695,913 to Terracol and Roulet, entitled "Shunt Effect Low Voltage Circuit Breaker"; and U.S. Pat. No. 5,296,664 to Crookston et al., entitled "Circuit Breaker with Positive Off Protection".

U.S. Pat. No. 5,369,384 to Heins, entitled "Power Circuit Breaker with a Breaker Mechanism and a Breaker Mechanism for a Power Circuit Breaker", which corresponds to German Patent No. 42 27 213 A1, is hereby incorporated by reference as if set forth in its entirety herein.

Additional examples of circuit breakers and components associated therewith which may be utilized in accordance with the present invention may be disclosed in the following U.S. Pat. No. 4,835,842 to Castonguay et al. on Jun. 6, 1989, entitled "Method of Assembling a Molded Case Circuit Breaker Operating Mechanism"; U.S. Pat. No. 5,200,725 to Arnold et al. on Apr. 6, 1993, entitled "Molded Case Circuit Breaker Multi-pole Crossbar Assembly"; U.S. Pat. No. 4,888,570 to Toda on Dec. 19, 1989, entitled "Circuit Breaker"; U.S. Pat. No. 3,005,066 to Powell on Oct. 17, 1961, entitled "Circuit Breaker"; U.S. Pat. No. 3,147,352 to Giessner et al. entitled "Automatic Circuit Breaker with Contact Arm Ball Joint"; U.S. Pat. No. 3,152,232 to Leonard entitled "Circuit Breaker Having Bimetal Rigidly Secured to Cradle"; U.S. Pat. No. 4,151,495 to Rys et al. on Apr. 24, 1979, entitled "Resetting Means for Trip Free Circuit Breaker Contact Operating Mechanism"; and U.S. Pat. No. 4,736,174 to Castonguay et al. on Apr. 5, 1988, entitled "Molded Case Circuit Breaker Operating Mechanism".

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. P 44 42 417.5, filed on Nov. 29, 1994, having inventors Volker Heins and Bogdan Zabrocki, and DE-OS 44 42 417.5 and DE-PS 44 42 417.5 and International Application No. PCT/EP95/04461, filed on Nov. 14, 1995, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. Power circuit breaker comprising:

a housing;

at least one electrical contact area disposed within said housing;

a breaker mechanism to connect and disconnect with said at least one electrical contact area, said breaker mechanism being disposed within said housing;

said breaker mechanism comprising:

a switching shaft mechanism being pivotably disposed within said housing, said switching shaft mechanism being configured and disposed to contact said at least one electrical contact area to complete an electrical circuit;

a toggle lever mechanism being pivotably disposed within said housing, said toggle lever mechanism being connected to said switching shaft mechanism;

a first spring being disposed within said housing, said first spring being configured and disposed to provide a biasing force to pivot said toggle lever mechanism;

said switching shaft mechanism being configured and disposed to engage and disengage with said electric contact area in response to a pivotable displacement of said toggle lever mechanism;

said toggle lever mechanism comprising two toggle levers, said two toggle levers being disposed a substantial distance apart from one another along said switching shaft mechanism, said two toggle levers being substantially symmetrical with respect to one another;

said toggle lever mechanism being configured and disposed to provide an engaged position and a disengaged position;

said engaged position of said toggle lever mechanism being the position in which said switching shaft mechanism is in contact with said electrical contact area;

said disengaged position of said toggle lever mechanism being the position in which said switching shaft mechanism is disposed a distance from said electrical contact area;

said toggle lever mechanism and said first spring being configured and disposed to provide a change-over point;

said change-over point being disposed at a position between said engaged position of said toggle lever mechanism and said disengaged position of said toggle lever mechanism;

said change-over point providing a transition from increasing biasing force to decreasing biasing force exerted by said first spring on said toggle lever mechanism;

a release lever being pivotably disposed within said housing, said release lever being configured and disposed to block and unblock the displacement of said switching shaft mechanism;

said release lever being configured and disposed to block said switching shaft mechanism upon said toggle lever mechanism being between said change-over point and said engaged position;

an element for externally operating said toggle lever mechanism;

said operating element being configured and disposed to operatively pivotably displace said release lever; and a second spring being disposed within said housing, said second spring being disposed to provide a pretensioning force to said release lever.

2. The power circuit breaker according to claim 1 wherein:

said release lever comprises at least one latching stop; and said at least one latching stop of said release lever is configured and disposed to block and unblock the displacement of said switching shaft mechanism.

3. The power circuit breaker according to claim 2 comprising:

a support lever being pivotably disposed within said housing, said support lever being configured and disposed to engage and disengage said release lever, said support lever comprising a first end and a second end;

a device being disposed within said housing, said device being configured and disposed to respond to a tripping stimulus, said device comprising:

a latch lever being disposed to contact said support lever, said latch lever being configured to pivotably displace said support lever in response to a tripping stimulus; and a latch spring being disposed to provide a force to said latch lever;

a switching gate being pivotably disposed within said housing, said switching gate being configured and disposed to be displaceable by said operating element, said switching gate being configured to contact said first end of said support lever, said switching gate being configured to displace said support lever; and said second end of said support lever being disposed to cooperate with said device.

4. The power circuit breaker according to claim 3 wherein:

said switching shaft mechanism comprises:

a contact arm being configured and disposed to contact at least one electrical contact area to complete an electric circuit;

at least one cam, said at least one cam being configured and disposed to pivotably displace said contact arm in response to a pivotable displacement of said toggle lever mechanism;

said at least one cam comprises at least one stop dog; and said at least one stop dog being configured and disposed to engage and disengage with said at least one latching stop of said release lever.

5. The power circuit breaker according to claim 4 comprising:

a toggle-lever support mechanism to provide a connection between said operating element and said release lever;

said toggle-lever support mechanism being pivotably displaceable in response to a pivotable displacement of said operating element;

said toggle-lever support mechanism comprising at least one stop web; and said at least one stop web being configured and disposed to displace said release lever in response to a pivotable displacement of said operating element.

6. The power circuit breaker according to claim 5 wherein:

said switching shaft mechanism comprises a toggle switch; and said operating element comprises said toggle switch of said switching shaft mechanism.

7. The power circuit breaker according to claim 5 wherein said operating element comprises an operating handle of a rotary drive.

8. Power circuit breaker comprising:

a housing;

at least one electrical contact area disposed within said housing;

a breaker mechanism to connect and disconnect with said at least one electrical contact area, said breaker mechanism being disposed within said housing;

said breaker mechanism comprising:

a toggle switching mechanism being pivotably disposed within said housing, said toggle switching mechanism being configured and disposed to contact said at least one electrical contact area to complete an electrical circuit;

said toggle switching mechanism comprising:

two toggle levers;

a toggle lever axle;

said two toggle levers being disposed a substantial distance apart from one another along said toggle lever axle;

said two toggle levers being pivotably disposed around said toggle lever axle;

said two toggle levers being substantially symmetrical with respect to one another;

a first spring being disposed within said housing, said first spring being configured and disposed to provide a biasing force to pivot said toggle switching mechanism;

said toggle switching mechanism being configured and disposed to engage and disengage with said at least one electrical contact area in response to a force provided by said first spring;

said toggle switching mechanism being configured and disposed to provide an engaged position and a disengaged position;

said engaged position of said toggle switching mechanism being the position in which said toggle switching mechanism is in contact with said electrical contact area;

said disengaged position of said toggle switching mechanism being the position in which said toggle switching mechanism is disposed a distance from said electrical contact area;

said toggle switching mechanism being configured and disposed to provide a change-over point;

said change-over point being disposed at a position between said engaged position of said toggle switching mechanism and said disengaged position of said toggle switching mechanism;

said change-over point providing a transition from increasing biasing force to decreasing biasing force exerted by said first spring on said toggle lever mechanism;

a release lever being pivotably disposed within said housing, said release lever being configured and disposed to block and unblock the displacement of said toggle switching mechanism;

a release lever axle;

said release lever being pivotably disposed on said release lever axle;

said release lever being configured and disposed to block said toggle switching mechanism between said change-over point and said engaged position;

an element for externally operating said toggle switching mechanism;

said element being configured and disposed to operatively pivotably displace said release lever; and a second spring being disposed within said housing, said second spring being disposed to provide a pretensioning force to said release lever.

9. The power circuit breaker according to claim 8 wherein:

said release lever comprises at least one latching stop; and said at least one latching stop of said release lever is configured and disposed to block and unblock the displacement of said toggle switching mechanism.

10. The power circuit breaker according to claim 9 wherein:

a support lever being pivotably disposed within said housing, said support lever being configured and disposed to engage and disengage said release lever, said support lever comprising a first end and a second end;

a device being disposed within said housing, said device being configured and disposed to respond to a tripping stimulus, said device comprising:

a latch lever being disposed to contact said support lever, said latch lever being configured to pivotably displace said support lever in response to a tripping stimulus; and a latch spring being disposed to provide a force to said latch lever;

a switching gate being pivotably disposed within said housing, said switching gate being configured and disposed to be displaceable by said operating element, said switching gate being configured to contact said first end of said support lever, said switching gate being configured to displace said support lever; and said second end of said support lever being disposed to cooperate with said device.

11. The power circuit breaker according to claim 10 wherein:

said toggle switching mechanism comprises:

a contact arm being configured and disposed to contact said at least one electrical contact area to complete an electric circuit;

at least one cam, said at least one cam being configured and disposed to pivotably displace said contact arm in response to a force provided by said first spring;

said at least one cam comprises at least one stop dog; and said at least one stop dog being configured and disposed to engage and disengage with said at least one latching stop of said release lever.

12. The power circuit breaker according to claim 11 comprising:

a toggle-lever support mechanism to provide a connection between said operating element and said release lever;

said toggle-lever support mechanism being pivotably displaceable in response to a pivotable displacement of said operating element;

said toggle-lever support mechanism comprising at least one stop web; and said at least one stop web being configured and disposed to displace said release lever in response to a pivotable displacement of said operating element.

13. The power circuit breaker according to claim 12 wherein:

said toggle switching mechanism comprises a toggle switch; and said operating element comprises said toggle switch of said toggle switching mechanism.

14. A switch latch arrangement for a low-voltage switching device such as in a power circuit breaker, said switch latch arrangement comprising:

a housing;

at least one electrical contact area being disposed within said housing;

a toggle switching mechanism being pivotably disposed within said housing;

said toggle switching mechanism being configured and disposed to contact said at least one electrical contact area to complete an electric circuit;

said toggle switching mechanism being configured and disposed to provide an engaged position and a disengaged position;

said engaged position of said toggle switching mechanism being the position in which said toggle switching mechanism is in contact with said electrical contact area;

said disengaged position of said toggle switching mechanism being the position in which said toggle switching mechanism is disposed a distance from said electrical contact area;

said toggle switching mechanism being configured to provide a change-over point, which said change-over point is disposed at a position between said engaged position of said toggle switching mechanism and said disengaged position of said toggle switching mechanism, and which said change-over point provides a transition from increasing biasing force to decreasing biasing force exerted by said toggle lever mechanism;

a release lever being pivotably disposed within said housing, said release lever being configured and disposed to block and unblock the displacement of said toggle switching mechanism;

said release lever being configured and disposed to block said toggle switching mechanism between said change-over point and said engaged position;

an element for externally operating said toggle switching mechanism;

said operating element being configured and disposed to operatively pivotably displace said release lever; and a spring being disposed within said housing, said spring being disposed to provide a pretensioning force to said release lever.

15. The switch latch arrangement according to claim 14 wherein:

said release lever comprises at least one latching stop; and said at least one latching stop of said release lever is configured and disposed to block and unblock the displacement of said toggle switching mechanism.

16. The switch latch according to claim 15 comprising:

a support lever being pivotably disposed within said housing, said support lever being configured and disposed to engage and disengage said release lever, said support lever comprising a first end and a second end;

a device being disposed within said housing, said device being configured and disposed to respond to a tripping stimulus, said device comprising:

a latch lever being disposed to contact said support lever, said latch lever being configured to pivotably displace said support lever in response to a tripping stimulus; and a latch spring being disposed to provide a force to said latch lever;

a switching gate being pivotably disposed within said housing, said switching gate being configured and disposed to be displaceable by said operating element, said switching gate being configured to contact said first end of said support lever, said switching gate being configured to displace said support lever; and said second end of said support lever being disposed to cooperate with said device.

17. The switch latch arrangement according to claim 16 wherein:

said toggle switching mechanism comprises:

a contact arm being configured and disposed to contact said at least one electrical contact area to complete an electric circuit;

at least one cam, said at least one cam being configured and disposed to pivotably displace said contact arm in response to a pivotable displacement of said toggle switching mechanism;

said at least one cam comprises at least one stop dog; and said at least one stop dog being configured and disposed to engage and disengage with said at least one latching stop of said release lever.

18. The switch latch arrangement according to claim 17 comprising:

a toggle-lever support mechanism to provide a connection between said operating element and said release lever;

said toggle-lever support mechanism comprising at least one stop web;

said at least one stop web being configured and disposed to displace said release lever in response to a pivotable displacement of said operating element.

19. The switch latch arrangement according to claim 18 wherein:

said toggle switching mechanism comprises a toggle switch; and said operating element comprises said toggle switch of said toggle switching mechanism.

20. The switch latch arrangement according to claim 18 wherein said operating element comprises an operating handle of a rotary drive.

* * * * *